US007878344B2

(12) United States Patent
Martin et al.

(10) Patent No.: US 7,878,344 B2
(45) Date of Patent: Feb. 1, 2011

(54) TUCK AND STORE RACK

(75) Inventors: Robert Henry Martin, Anderson, SC (US); James Hughes, Hendersonville, TN (US); David Shadwick, White House, TN (US); James Lewis Ayers, Springfield, TN (US)

(73) Assignee: Electrolux Home Products, Inc., Cleveland, OH (US)

( * ) Notice: Subject to any disclaimer, the term of this patent is extended or adjusted under 35 U.S.C. 154(b) by 355 days.

(21) Appl. No.: 12/061,733

(22) Filed: Apr. 3, 2008

(65) Prior Publication Data

US 2009/0250420 A1 Oct. 8, 2009

(51) Int. Cl.
*A47F 5/08* (2006.01)

(52) U.S. Cl. ..... 211/153; 211/181.1; 211/175; 126/339; 126/337 A

(58) Field of Classification Search ..... 211/133.2, 211/133.6, 133.5, 134, 153, 181.1, 175; 312/410, 408, 301; 126/339, 337 A, 337 R
See application file for complete search history.

(56) References Cited

U.S. PATENT DOCUMENTS

| | | | | | |
|---|---|---|---|---|---|
| 1,925,371 | A | * | 9/1933 | Charter | 211/153 |
| 1,997,432 | A | * | 4/1935 | Replogle | 211/153 |
| 2,057,429 | A | * | 10/1936 | Heim | 211/153 |
| 2,086,118 | A | * | 7/1937 | Chadwick | 211/153 |
| 2,095,811 | A | * | 10/1937 | Goulooze | 312/274 |
| 2,144,278 | A | | 1/1939 | Wallace | |
| 2,465,806 | A | * | 3/1949 | Jewell | 211/153 |
| 4,553,523 | A | * | 11/1985 | Stohrer, Jr. | 126/9 B |
| 4,651,713 | A | * | 3/1987 | Ondrasik, II | 126/339 |
| D291,646 | S | * | 9/1987 | Koziol | D7/409 |
| 6,148,813 | A | * | 11/2000 | Barnes et al. | 126/339 |
| 6,349,717 | B1 | | 2/2002 | Thompson et al. | |
| 6,938,617 | B2 | | 9/2005 | Le et al. | |
| 2002/0162809 | A1 | * | 11/2002 | Hartel | 211/26 |

(Continued)

FOREIGN PATENT DOCUMENTS

| | | |
|---|---|---|
| DE | 4014823 | 11/1991 |

(Continued)

OTHER PUBLICATIONS

International Search Report for PCT/US2009/038067, mailed Oct. 22, 2009, 3 pages.

*Primary Examiner*—Darnell M Jayne
*Assistant Examiner*—Devin Barnett
(74) *Attorney, Agent, or Firm*—Pearne & Gordon LLP

(57) ABSTRACT

A rack for an appliance includes a main section including a frame adapted to be supported within a cavity of an appliance, and a primary platform area. The rack also includes an auxiliary section having an auxiliary platform area and being adapted to be movable relative to the main section between a retracted position and an extended position. In one example, a track is coupled to the frame and the auxiliary section is movable about the track. The auxiliary section can include a support bar configured for sliding engagement with the track. In another example, the track includes a first planar support area and a second planar support area for supporting the auxiliary section. In yet another example, the rack further includes a first stop portion to maintain the auxiliary section in the extended position, and a second stop portion to maintain the auxiliary section in the retracted position.

27 Claims, 8 Drawing Sheets

U.S. PATENT DOCUMENTS

| | | | | |
|---|---|---|---|---|
| 2004/0069299 | A1 | 4/2004 | Le et al. | |
| 2005/0218096 | A1* | 10/2005 | Dunn | 211/153 |
| 2006/0027105 | A1 | 2/2006 | Woon | |
| 2006/0102015 | A1* | 5/2006 | Baker et al. | 99/450 |
| 2006/0185661 | A1* | 8/2006 | Metcalf et al. | 126/339 |
| 2007/0095814 | A1* | 5/2007 | Dunn | 219/400 |
| 2007/0137501 | A1* | 6/2007 | Manuel | 99/450 |

FOREIGN PATENT DOCUMENTS

| | | |
|---|---|---|
| EP | 1892476 | 2/2008 |

* cited by examiner

TUCK AND STORE RACK

RELATED APPLICATIONS

Not applicable.

BACKGROUND OF THE INVENTION

1) Field of the Invention

The present invention relates to racks for appliances, and more particularly, to a tuck and store rack for an oven.

2) Description of Prior Art

Ovens often have one or more racks generally within the oven. The racks are useful for the placing of cookware, food, and other items, within the oven. The racks place the cookware generally towards the middle of the oven, and keep the cookware away from heating elements and the like. In addition, ovens with multiple racks allow for placement of cookware on a variety of levels within the oven, thereby increasing the total volume of available cooking space.

The racks are often supported by ledges formed along the inner walls of the oven. The racks are then movable in and out of the oven on the ledges. This allows the racks to be removed from the oven for cleaning or for other purposes. Often, the racks may be partially removed from the oven so as to allow easier access to items placed on the racks. The ledges also facilitate vertical adjustment of the racks within the oven cavity.

Oven racks are often of wire form construction. More specifically, an outer wire frame and a support platform, which is constituted by a plurality of fore-to-aft and laterally spaced wires, define a typical oven rack. The wires are substantially evenly spaced across the entire rack for use in supporting food items to be cooked.

BRIEF SUMMARY OF THE INVENTION

The following presents a simplified summary of the invention in order to provide a basic understanding of some aspects of the invention. This summary is not an extensive overview of the invention. It is intended to identify neither key nor critical elements of the invention nor delineate the scope of the invention. Its sole purpose is to present some concepts of the invention in a simplified form as a prelude to the more detailed description that is presented later.

In accordance with an aspect of the present invention, a rack for an appliance is provided including a main section including a frame adapted to be supported within a cavity of an appliance, and a primary platform area. The rack also includes a track coupled to the frame and including a lowered portion that depends below the primary platform area, and an auxiliary section supported by the track and having an auxiliary platform area. The auxiliary section is adapted to be movable about the track relative to the main section between a retracted position and an extended position. The auxiliary platform area is adapted to support various items when it is in the extended position.

In accordance with another aspect of the present invention, a rack for an appliance is provided including a main section including a frame adapted to be supported within a cavity of an appliance, and having a primary platform area. The rack also includes a track coupled to the frame and including a first planar support area and a second planar support area. The second planar support area is disposed below the first planar support area. The rack also includes an auxiliary section supported by the track and having an auxiliary platform area. The auxiliary section is adapted to be movable about the track relative to the main section between a retracted position and an extended position. The auxiliary section is supported by the first planar support area when in the extended position, and by the second planar support area when in the retracted position.

In accordance with another aspect of the present invention, a rack for an appliance is provided including a main section including a frame adapted to be supported within a cavity of an appliance, and a primary platform area. The rack also includes an auxiliary section having an auxiliary platform area. The auxiliary section is movable relative to the main section between a retracted position and an extended position. The rack further includes a first stop portion to maintain the auxiliary section in the extended position, and a second stop portion to maintain the auxiliary section in the retracted position.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
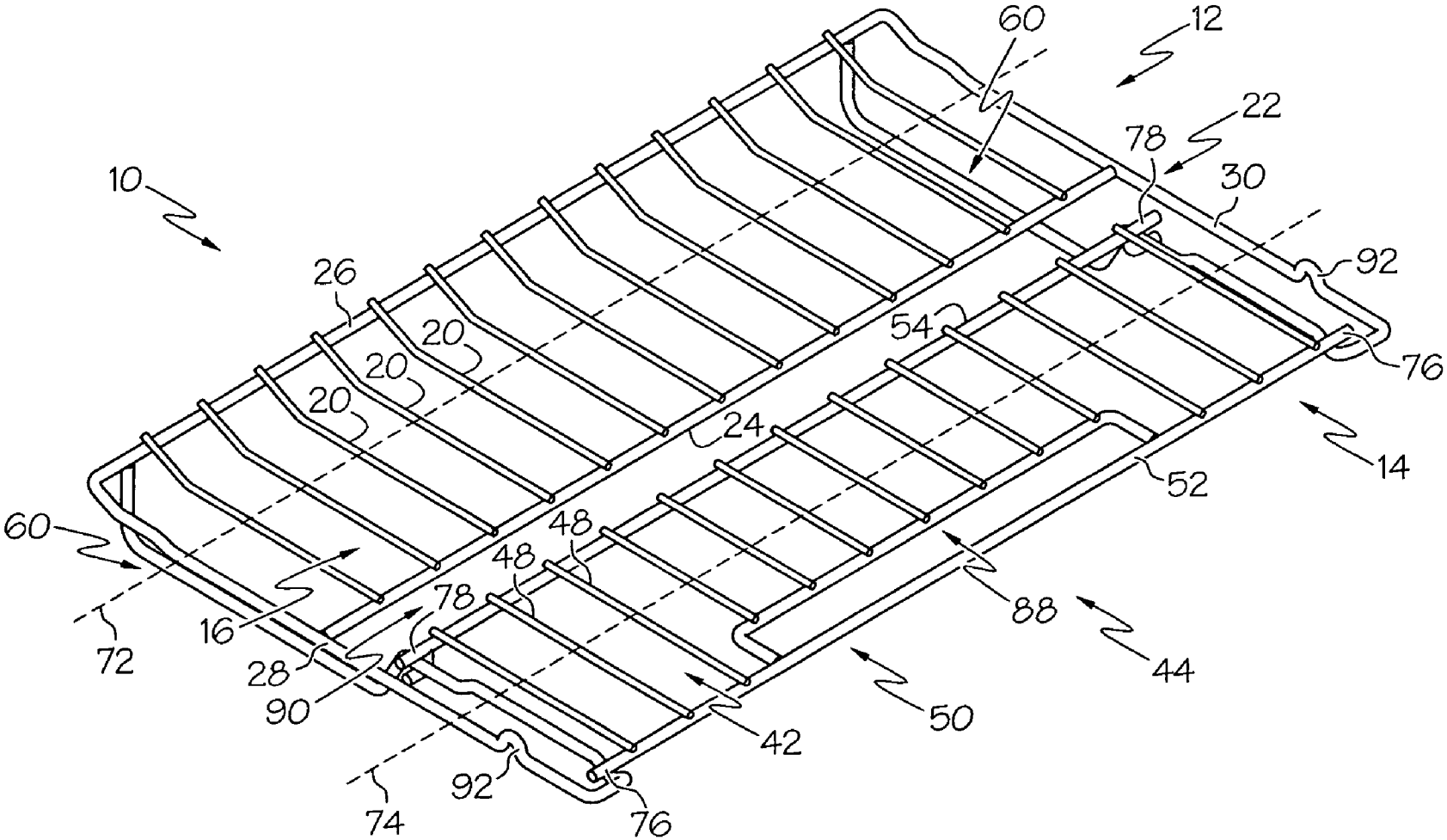
FIG. 1 illustrates a perspective view of an example tuck and store rack in an extended position in accordance with an aspect of the invention.

Example embodiments of a rack that incorporates aspects of the present invention are shown in the drawings. It is to be appreciated that the shown examples are not intended to be a limitation on the present invention. For example, one or more aspects of the present invention can be utilized in other embodiments and even other types of devices.

Figure 2:
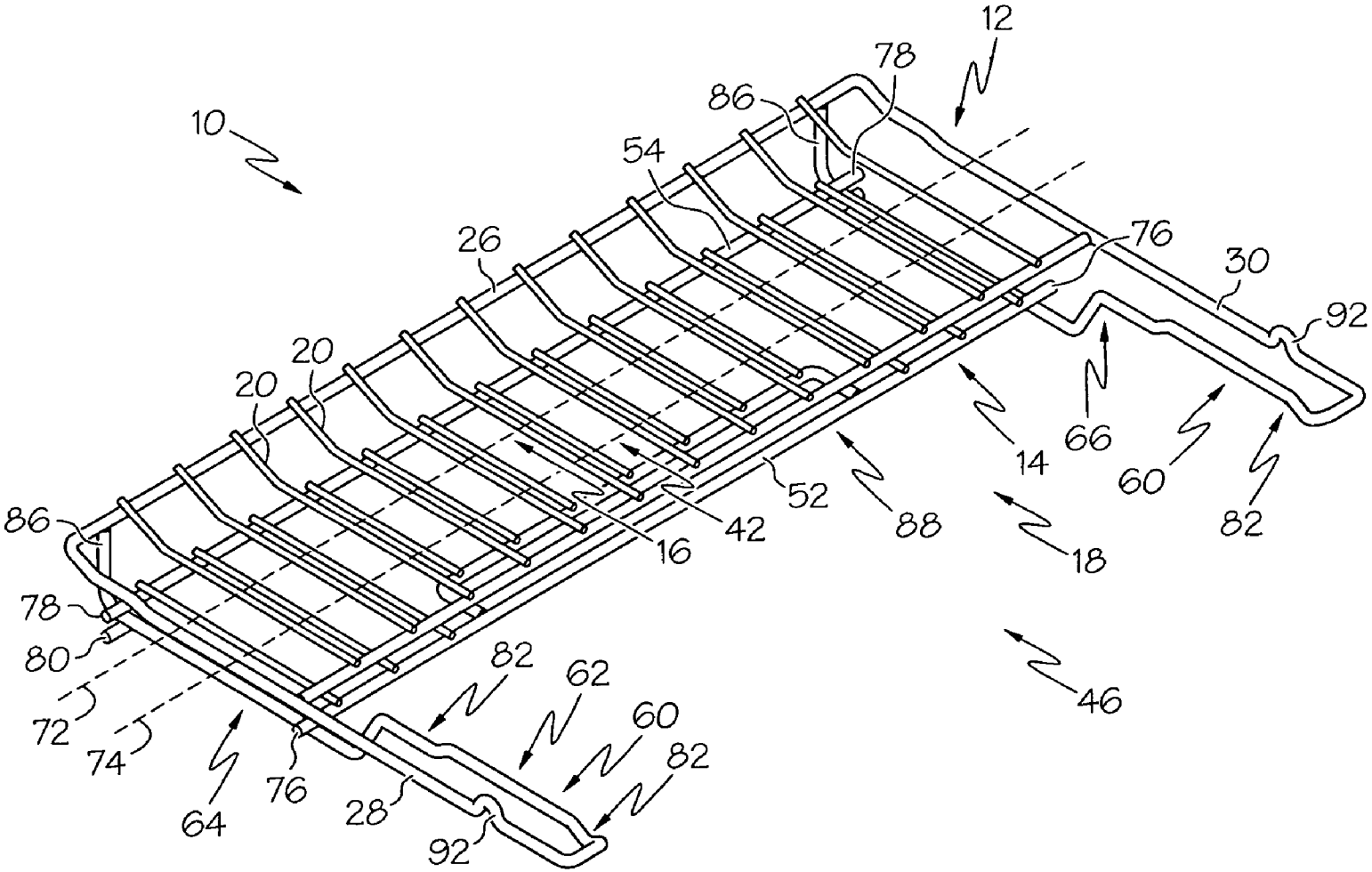
FIG. 2 is similar to FIG. 1, but shows the rack in a retracted position.

Referring initially to FIG. 1, an example of a rack 10 for an appliance, such as an oven, refrigerator, or freezer is illustrated in accordance with an aspect of the present invention. The rack 10 includes a main section 12 and an auxiliary section 14. As shown, the auxiliary section 14 can be relatively smaller than the main section 12 (e.g., occupying a partial area of the rack 10). Both the main section 12 and the auxiliary section 14 can be constructed from metal wire, such as iron coated with nickel or steel coated with porcelain. However, it is to be appreciated that either, or both of the main section 12 and the auxiliary section 14 can be constructed from various other suitable materials (e.g., aluminum, sheet metal, or the like). Moreover, it is to be appreciated that the main section 12 can be constructed from a first material and the auxiliary section 14 can be constructed from a second different material. The auxiliary section 14 is adapted to be movable relative to the main section 12, as shown in FIG. 2 and as will be discussed more fully herein.

The main section 12 can include a primary platform area 16 for supporting various items within an appliance The rack 10 can include a support frame 22, and a plurality of elongated support bars 20 can extend across the support frame 22 to form the primary platform area 16. As shown, the frame can include a front bar 24, rear bar 26, and opposed side bars 28, 30 that can be attached together to form the support frame 22 in various manners, such as by welding, adhesives, or fasteners, and/or can even be formed from a single piece of wire. The elongated support bars 20 can extend between the front bar 24 and the rear bar 26, though it is to be appreciated that the support bars 20 can also be oriented in various manners.

Figure 3:
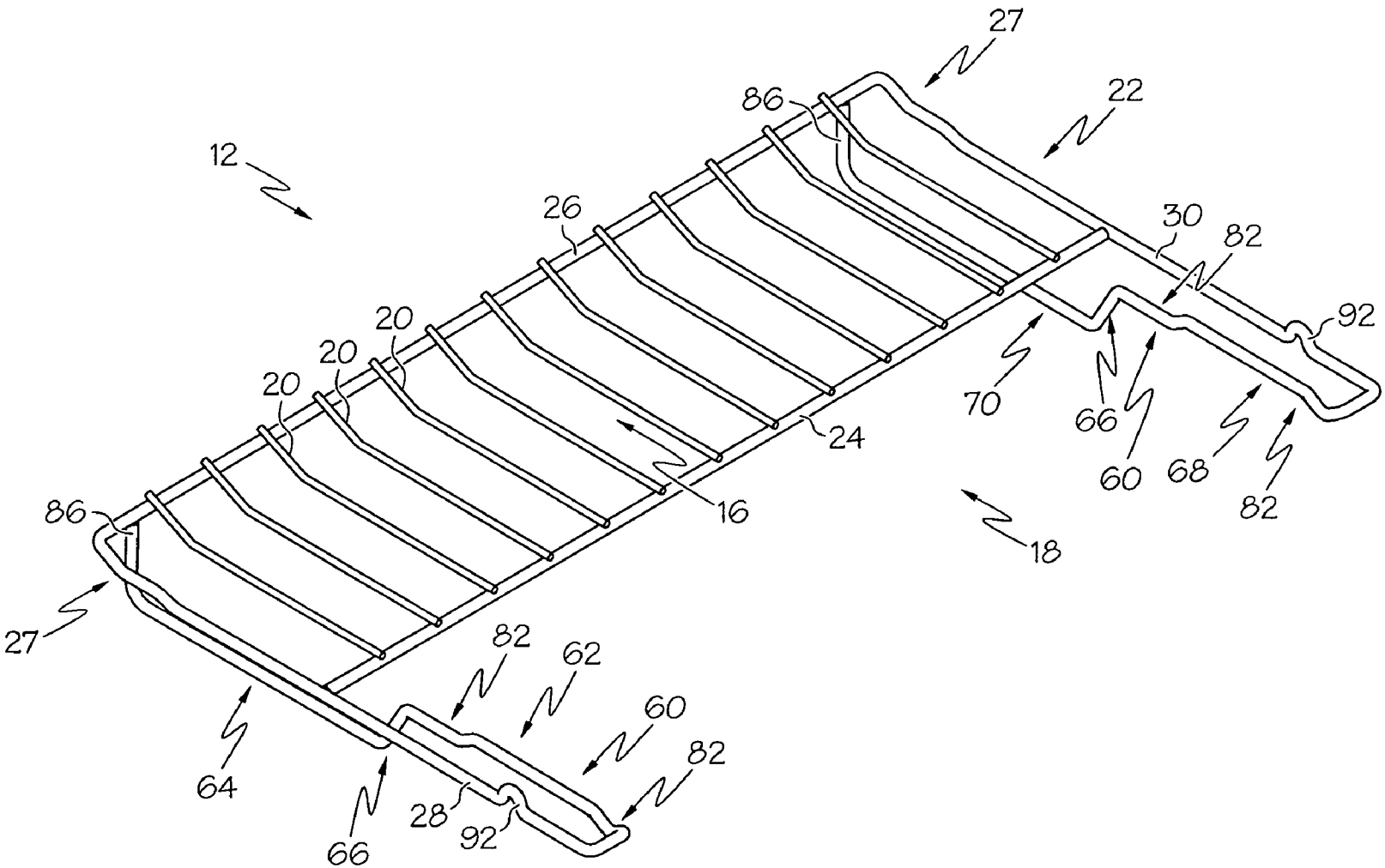
FIG. 3 illustrates a perspective view of an example main section of the tuck and store rack of FIG. 1.

As shown in FIG. 3, the support frame 22 can have a generally rectangular geometry, through it is to be appreciated that the support frame 22 can also have various other geometries. For example, as shown in FIG. 2, the support frame 22 can be formed so as to create an open area 18 in the rack 10, as will be discussed more completely herein. Additionally, as shown, the rear bar 26 of the support frame 22 can be located at a relatively higher position with respect to the front bar 24. Thus, a portion of the support members 20 attached to the rear bar 26 can act as a stop 27 to limit the extent to which an item can be inserted into an oven cavity. In addition or alternatively, the main section 12 can include an additional platform area (not shown) located adjacent the rear bar 26 to provide support for even larger items.

Additionally, the rack 10 can include at least one cross member (not shown) or strengthening member provided across a portion of the primary platform 16 area to provide strength. The cross member(s) can operate to mitigate sagging of the primary platform area 16 with respect to the front bar 24 when heavy food, cookware, or the like (not shown) is placed on the primary platform area 16. Sagging of the primary platform area 16 presents problems with easily sliding the food or cookware from the primary platform area 16 without interference from the front bar 24. The ends of the support members 20 and/or the cross member(s) can be welded (e.g., spot welded), otherwise secured to, or even formed together as a single unit with, the various portions of the rack 10. Further, the support members 20, frame 22, and/or cross member(s) can be manufactured from metal wire or any other suitable material which provides adequate strength to support items such as cake pans, pizza stones and casseroles, or the like, and withstands the heat of an oven. It is to be appreciated that the cross member(s) can be oriented in various other manners, including transverse or angled relative to the elongated support members 20.

Figure 4:
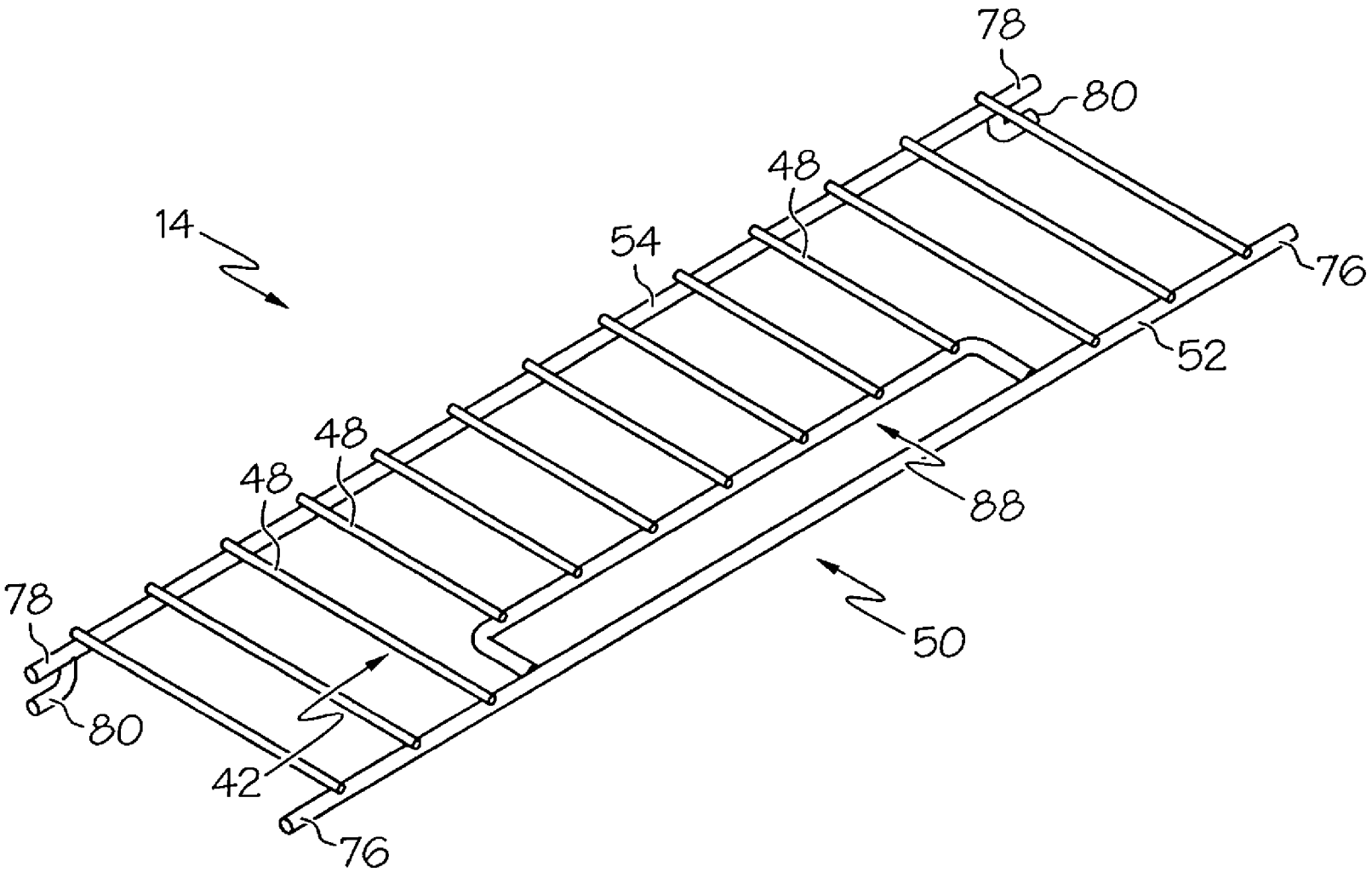
FIG. 4 illustrates a perspective view of an example auxiliary section of the tuck and store rack of FIG. 1.

As stated previously, the rack 10 also includes an auxiliary section 14 (see FIG. 4) having an auxiliary platform area 42. The auxiliary section 14 can be adapted to be movable relative to the main section 12 to be moved between an extended position 44, as shown in FIG. 1, and a retracted position 46, as shown in FIG. 2. The auxiliary section 14 is adapted to support various items, such as cookware, food, and other items, within the oven. As can be appreciated, the auxiliary section 14 can be adapted to support various items independent of whether it is in the extended position 44 or the retracted position 46. For example, in the extended position 44, the auxiliary section 14 can be adapted to support various items, such as a large cookie sheet, in conjunction with the primary platform area 16, though it is to be appreciated that the auxiliary section 14 can also support the item independently. In another example, when in the retracted position 46, the auxiliary section 14 can also be adapted to independently support various items. In yet another example, the main section 12 of the rack 10 can be adapted to move between a retracted and an extended position (not shown) relative to the oven cavity 84 (see FIG. 7), and the auxiliary section 14 can be further adapted to independently support various items regardless of the positioning of the main section 12. As can be appreciated, the primary platform area 16 can be adapted to support various items (e.g., food to be cooked, cookware, or the like) independent of whether the auxiliary section 14 is in the extended or retracted position 44, 46.

The auxiliary platform area 42 can also include a plurality of elongated support bars 48. For example, the auxiliary platform area 42 can include a support frame 50, and the elongated support bars 48 can extend across the support frame 50. As shown, the frame 50 can include a front bar 52 and a rear bar 54 having the elongated support bars 48 extending therebetween, though it is to be appreciated that the support bars 48 can be oriented in various other manners. The frame 50 can also include opposed side bars (not shown). In addition or alternatively, the auxiliary section 14 can be configured to include various geometries, such as, for example, square, rectangular, triangular, polygonal, circular, oval and/or elliptical, and the rack 10 can even include a plurality of auxiliary sections 14 (not shown).

Additionally, the auxiliary section 14 can include at least one cross member (not shown) or strengthening member provided across a portion of the auxiliary platform 42 area to provide strength. As with the main section 12, the cross member(s) (not shown) can operate to mitigate sagging of the auxiliary platform area 42 with respect to the front bar 52 when heavy food, cookware, or the like is placed on the auxiliary platform area 42. The ends of the support members 48 and/or the cross member(s) (not shown) can be welded (e.g., spot welded), otherwise secured to, or even formed together as a single unit with, the various portions of the auxiliary section 14. Further, the support members 48, frame 50, and/or cross member(s) (not shown) can be manufactured from metal wire or any other suitable material which provides adequate strength to support items such as cake pans, pizza stones and casseroles, or the like, and withstands the heat of an oven.

As stated previously, the auxiliary section 14 can be adapted to be movable relative to the main section 12 between an extended position 44 and a retracted position 46. The auxiliary section 14 can be movable in various manners. In one example, the auxiliary section 14 can be adapted to be slidable relative to the main section 12, such as about a track 60, as will be discussed more fully herein. In another example, the auxiliary section 14 can be adapted to telescope relative to the main section 12. In yet another example, the auxiliary section 14 can be adapted to move in an overlapping fashion relative to the main section 12. In still yet another example, the auxiliary section 14 can be adapted to be removed from the main section 12 and subsequently moved relative thereto.

In one example, the main section 12 can include a track 60 coupled to the frame 22. As shown, the main section 12 can include a pair of tracks 60, though various numbers of tracks can be used. Accordingly, as shown in FIGS. 1-2 and 7-8, the auxiliary section 14 can be slidable about the track 60 in a forwards and backwards manner (e.g., "into" and "out of" an appliance) relative to the main section 12 for movement between the extended and retracted positions 44, 46. The track 60 can be a separate element removably or non-removably fastened to the frame 22, such as by way of fasteners, adhesives, welding, clips, or the like. In addition or alternatively, some or all of the track 60 can be formed with the frame 22. For example, as shown, the track 60 can have one portion formed with the front and/or side bars 24, 28, 30, and another portion attached (e.g., welded, etc.) to the rear bar 26. The track 60 can be formed of metal wire, such as iron coated with nickel or steel coated with porcelain, though it can also be constructed from various other suitable materials (e.g., aluminum, sheet metal, or the like).

The track 60 can be generally continuous along its length, though it could include removed sections. As shown, the track 60 can include a raised portion 62 and a lowered portion 64. The raised portion 62 can be generally coplanar with the side bars 28, 30, though it can also be disposed a distance above or below (as shown) the side bars 28, 30. The raised portion 62 can also be generally coplanar with the primary platform area 16. Additionally, the lowered portion 64 can depend a distance below the primary platform area 14 (e.g., disposed below the primary platform area 14). It is to be appreciated that the lowered portion 64 can be wholly or partly disposed below the primary platform area 14. The track 60 can also include at least one transition area 66 between the raised and lowered portions 62, 64. The transition area 66 can have various sloped geometries. For example, as shown, the transition area 66 can have a generally slanted or diagonal geometry to provide a generally continuous transition slope between the raised and lowered portions 62, 64. The transition area 66 can also have other geometries, such as a concave or convex curved surface, elliptical surface, stepped surface, generally ninety degree slope, etc., and/or even multiple transition areas 66 having similar or different transition geometries.

The track 60 can be configured to have a first planar support area 68 and a second planar support area 70. The first and second planar support areas 68, 70 can be arranged variously relative to each other. For example, they can be arranged generally parallel to each other, though they can also be angled relative to each other. In another example, as shown, the second planar support area 70 can be disposed, wholly or in part, below the first planar support area 68, though the second planar support area 70 can be located directly below the first planar support area 68, or below and offset a distance therefrom.

In addition or alternatively, as shown, the first and second planar support areas 68, 70 can be arranged such that the auxiliary section 14 is supported by the first planar support area 68 when it is in the extended position 44, and by the second planar support area 70 when it is in the retracted position 46. Thus, the auxiliary section 14 can be supported by the first planar support area 68 when it is in the extended position 44, and movable (e.g., slidable) along the track 60 through the transition area 66 towards the second planar support area 70 until it is in the retracted position 46. Further, as shown in FIGS. 1-2, the primary platform area 16 can extend along a first plane 72, while the auxiliary platform area 42 can extend along a second plane 74. Thus, as shown in FIG. 1, the first and second planar support areas 68, 70 can be arranged such that the first and second planes 72, 74 are generally coplanar when the auxiliary section 14 is in the extended position 44. As such, various items (e.g., food to be cooked, cookware, or the like) can be supported by both of the main and auxiliary sections 12, 14. Similarly, as shown in FIG. 2, the first and second planar support areas 68, 70 can be arranged such that the first and second planes 72, 74 are generally parallel when the auxiliary section 14 is in the retracted position 46.

The auxiliary section 14 can include various structures, such as one or more support bars, for engagement (e.g., sliding engagement or the like) with the track 60. In one example, as shown in FIG. 1, one end 76 of the front bar 52 of the auxiliary section 14 can extend a distance away so as to slide upon the track 60. The one end 76 can extend in a linear fashion, as shown, or can also have other geometries, such as curved, bent, triangular, square, etc. In another example, also as shown in FIG. 1, one end 78 of the rear bar 54 of the auxiliary section 14 can include a downwardly depending L-shaped member 80 that, together with the one end 78, forms a generally C-shaped geometry for engagement with the track 60. Such C-shaped geometry can be beneficial so as to limit vertical movement of the auxiliary section 14 (e.g., inhibit removal from the track 60) during movement of the auxiliary section 14. In another example, the C-shaped geometry can be formed with the one end 78 such that the L-shaped member 80 is not required. It is to be appreciated that any end of the auxiliary section 14 can include either of the ends 76, 78 described herein, or can also include various other end geometry or structure for engagement with the track 60 (e.g., telescopic sliders, wheels, rollers, channels, or the like). Thus, the support bar(s) can include any or all of the ends 76, 78, L-shaped structure 80, C-shaped geometry, etc. Further, any of the track 60 or ends 76, 78 can include various materials, coatings, lubricants, or the like to facilitate sliding engagement therebetween.

The track 60 can also include various structures, such as a stop member, for inhibiting movement of the auxiliary section 14 relative to the main section 12. Thus, such structure can maintain the auxiliary section 14 in either of the extended or retracted positions 44, 46 so as to inhibit, or even prevent, inadvertent movement of the auxiliary section 14. For example, the stop member can be adapted to inhibit movement of the auxiliary section 14 when the second plane 74 (e.g., the auxiliary platform area 42) is generally coplanar with the first plane 72 (e.g., the main platform area 16)j when in the extended position 44. In addition or alternatively, the stop member can be adapted to inhibit movement of the auxiliary section 14 when it is in the retracted position 46.

In one example, a stop member can include a depression 82 formed in the track 60. The depression 82 can be configured to capture or retain an end 76, 78 of the auxiliary section 14 and can have various geometries, such as a generally U-shaped geometry, slanted or sloped geometry, etc. Thus, when an end 76, 78 is located within the depression 82, it is retained therein by the force of gravity. Accordingly, if it is desired to move the auxiliary section 14, the end 76, 78 must be removed from the depression 82. In one example, the depression 82 can be configured such the end 76, 78 must be actively lifted out of the depression 82 (e.g., vertically raised) before the auxiliary section 14 can be moved. In addition or alternatively, the depression 82 can include a slanted or sloped structure such that the end 76, 78 can be automatically removed from the depression 82 upon the application of a sufficient horizontal force applied against the front bar 52 of the auxiliary section 14 (e.g., a sufficient "inward" push).

Further still, as shown, the track 60 can include multiple depressions 80 for each of the ends 76, 78. Even further still, the raised portion 62 of the track 60 can include a first stop member (e.g., a first depression 80), while the lowered portion 64 can include a second stop member. The second stop member can include a depression similar to that described above, though it can also include an abutment surface or the like. For example, the lowered portion 64 of the track 60 can include a projection formed therewith or attached thereto, or as shown, an upwardly-extending member 86 configured for attachment to the rear bar 26 of the main section 12. Thus, the upwardly-extending member 86 can act as the second stop member for limiting movement of the auxiliary section 14. For example, when either or both of the one end 78 or the L-shaped member 80 attached thereto strikes the upwardly-extending member 86, further rearward movement of the auxiliary section 14 will be limited, or even prevented. Of course, the lowered portion 64 can also include a depression or the like to further limit movement of the auxiliary section 14 after abutment with the upwardly-extending member 86. As can be appreciated, the track 60, or even the main section 12, can include various combinations of depressions, projections, upwardly-extending members, or the like for limiting movement of the auxiliary section 14. In another example, any or all of the stop members can include a locking member or assembly (not shown) for maintaining the auxiliary section 14 in either of the extended or retracted positions 44, 46.

The rack 10 can also include various other structures. In one example, the auxiliary section 14 can include a handle portion 88 adapted to facilitate movement of the auxiliary section 14 between the extended and retracted positions 44, 46. As shown, the handle 88 can be formed of a similar material as the main rack 12 (e.g., metal wire or the like) and can be attached to (e.g., welding or the like), or formed with, the front bar 52 of the auxiliary section 14. In addition or alternatively, the handle 88 can also be disposed at various other locations, and can even be formed as part of the front bar 52. The handle 88 can be configured to be grasped by a hand of a user, and can include various coatings and/or a covering member (e.g., silicone, porcelain, ceramic, or the like) adapted to insulate a user's hand from the heat of an oven. In addition or alternatively, the main section 12 can also include a handle (not shown) to facilitate movement of the rack 10 relative to the oven cavity (see FIG. 7). It is to be appreciated that the various additional features discussed herein are not intended to provide any limitation upon the present invention, and that modification of the features and or the addition of other features are contemplated to be within the scope of the invention. In another example, the main section 12 can include an upward-facing projection 92 integrally formed in the wire frame of each of the sides 28, 30 of the support frame 22 to facilitate alignment of the rack 10 within an appliance (see FIGS. 7-8).

The rack 10 can also be configured so as to provide a spacing gap 90 located between the main section 12 and the auxiliary section 14. As shown in FIG. 1, the spacing gap 90 can be located between the front bar 24 of the main section 12 and the rear bar 54 of the auxiliary section 14, though it can also be located at various other locations. The spacing gap 90 can provide a sufficient clearance area to enable the auxiliary rack 14 to move along the track 60 between the extended and retracted positions 44, 46. As can be appreciated, the size and geometry of the spacing gap 90 can be determined by the relative spacing, geometry, and/or the dimensions (e.g., the thicknesses) of the front bar 24 and the rear bar 54.

Further still, the auxiliary section 14 can be adapted to be removable from the main section 12. For example, the auxiliary section 14 can be completely removed from the main section 12 such that the main section can remain within an oven while the auxiliary section 14 is removed therefrom. For example, when the auxiliary section 14 is removed from the main section 12, it can be stored or used as a cooling rack for supporting hot items or baked goods on a counter top. Thus, the auxiliary section 14 can include a plurality of support legs and/or support feet (not shown) or the like to support the auxiliary section 14 about a counter if it is employed as a cooling rack. In one example, each end 76, 78 can include an L-shaped member 80 that can each act as a support foot for supporting the auxiliary section 14. Since the auxiliary section 14 is relatively small and light, its removal from the main rack can be readily accomplished with little effort. In one example, the auxiliary section 14 can be removed from the main section 12 by orienting it at an angle relative to the main section 12, though other methods of removal are also contemplated.

In addition or alternatively, the primary platform area 16 and the secondary platform area 18 can each be adapted to support various items (e.g., food to be cooked, cookware, or the like) independent of whether the auxiliary section 14 is removed from the main section 12. Thus, the primary platform section 16 can support various items regardless of whether the auxiliary section 14 is in the extended or retracted positions 44, 46, or is completely removed from the main section 12.

Figure 5:
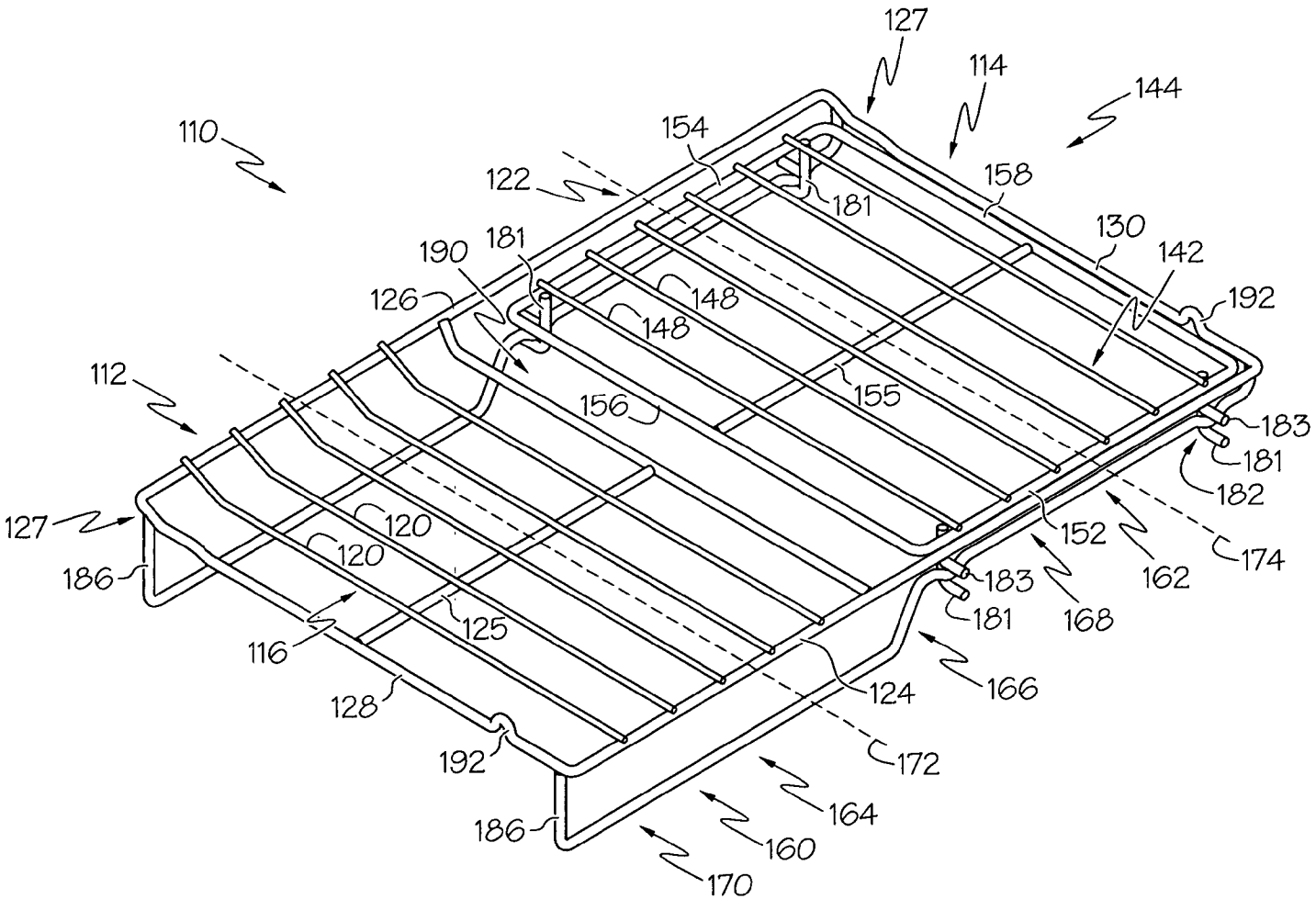
FIG. 5 illustrates a perspective view of another example tuck and store rack in an extended position in accordance with an aspect of the invention.
Figure 6:
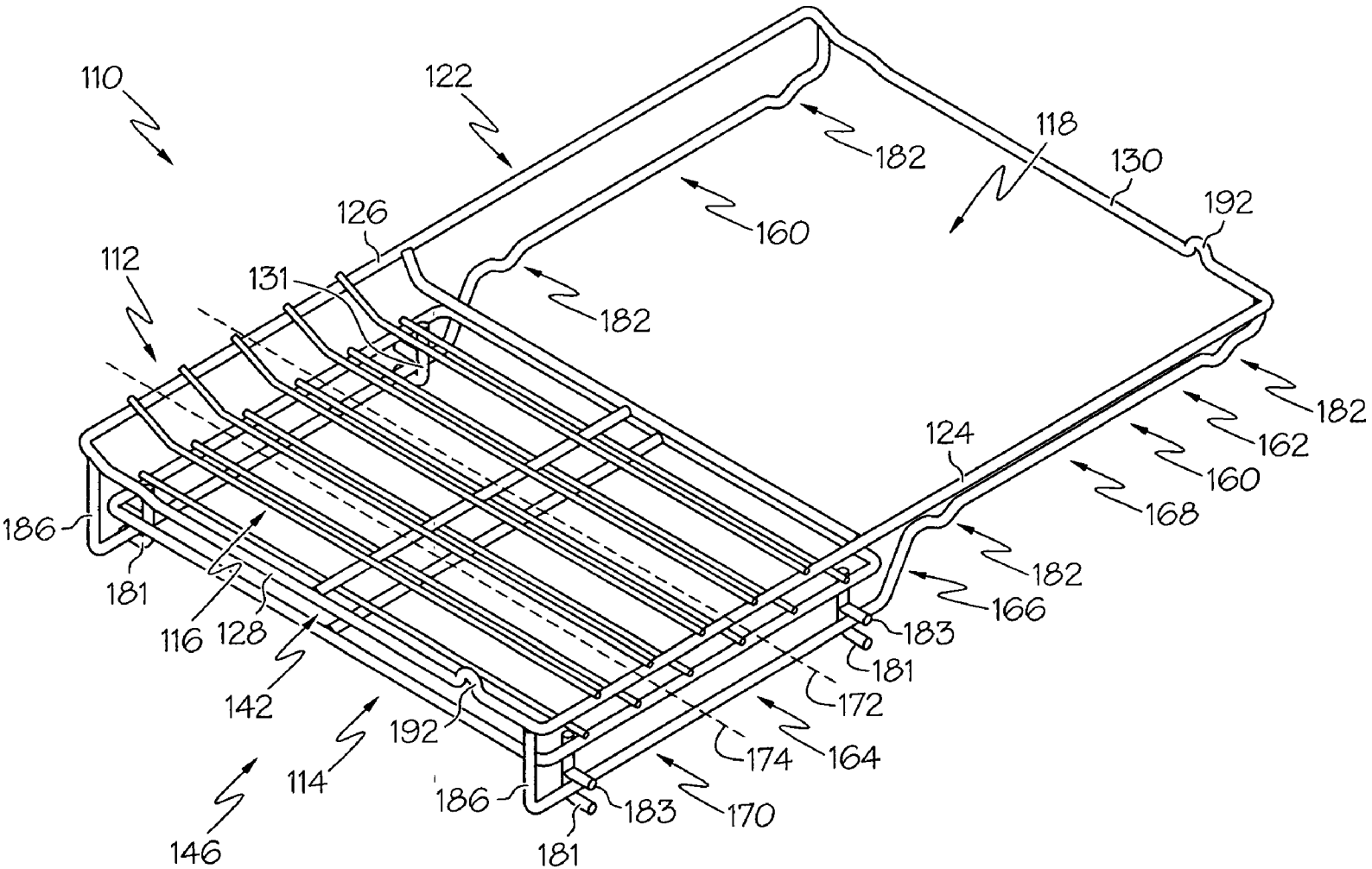
FIG. 6 is similar to FIG. 5, but shows the rack in a retracted position.

Turning now to FIGS. 5-6, another example embodiment of a rack 110 is shown in accordance with another aspect of the present invention. The example rack 110 includes many similar or identical elements to the rack 10 previously described herein. Accordingly, for the sake of brevity, elements similar or identical to those discussed above regarding FIGS. 1-4 have been given similar item numbers in FIGS. 5-6, though in the 100 series (e.g., rack 10 is now rack 110). Moreover, additional or different elements will be designated with different item numbers and discussed in detail below. It is to be appreciated that either of the racks 10, 110 can have similar, identical, or different structure, and that either can operate in similar, identical, or different manners.

As before, the rack 110 can include a main section 112 and an auxiliary section 114. Additionally, the rack 110 can also include at least one cross member 125, 155 or strengthening member provided across a portion of the primary platform 116 area and/or the auxiliary platform area 142, respectively, to provide strength. The cross member(s) 125, 155 can operate to mitigate sagging of the primary and/or auxiliary platform areas 116, 124 with respect to the front bar 124, 152 when heavy food, cookware, or the like (not shown) is placed on the primary and/or auxiliary platform areas 116, 142. The cross member(s) 125, 155 can be welded (e.g., spot welded), otherwise secured to, or even formed together as a single unit with, the various portions of the rack 110, and can be manufactured from metal wire or any other suitable material which provides adequate strength to support items such as cake pans, pizza stones and casseroles, or the like, and withstands the heat of an oven. It is to be appreciated that the cross member(s) can be oriented in various other manners, including transverse or angled relative to the elongated support members 120, 148. Further, though not shown, the auxiliary section 114 can include a handle similar to that (e.g., handle 88) discussed previously herein.

In addition or alternatively, the frame 150 of the auxiliary section 114 can include opposed side bars 156, 158 coupled to the front and rear bars 152, 154, though such side bars 156, 158 are not required. Thus, as shown, the frame 150 can be generally continuous around the perimeter of the auxiliary platform area 142. Further, though the main section 112 is shown as having a generally continuous frame 122, it is to be appreciated that such frame 122 can also be discontinuous. For example, the portion of the front bar 124 located adjacent the front bar 152 of the auxiliary section 114 can be removed to create a larger, more accessible open area 118. Further alterations to the frame 122 are contemplated and are considered to be within the scope of the present invention.

Also as before, the rack 110 can include a track 160 configured to guide the movement of the auxiliary section 114 relative to the main section 112. However, as shown in FIGS. 5-6, the rack 110 can be configured such that the auxiliary section 114 is adapted to be slidable about the track 160 in a side-to-side transverse manner relative to the main section 112 for movement between the extended and retracted positions 144, 146. That is, where the main section 112 can be adapted to move into and out of an appliance along a first direction, the auxiliary section 114 can be adapted to move along a second direction generally transverse to the first direction (e.g., side-to-side). Thus, as can be seen by a comparison of FIGS. 1-2 relative to FIGS. 5-6, the first and second planes 172, 174 of the main and auxiliary racks 112, 114 of the instant embodiment are oriented generally orthogonal to those of the previous embodiment. Further, as shown in FIG. 5, the auxiliary platform area 142 can still be positioned generally coplanar with the main platform area 116 when the auxiliary section 114 is in the extended position 144. Similarly, as shown FIG. 6, the auxiliary platform area 142 can still be moved to a position located below, and/or parallel to, the main platform area 116 when the auxiliary section 114 is in the retracted position 146.

However, to accommodate the difference in movement, the track 160 can be modified accordingly. For example, as shown, the track 160 can be attached at either or both ends to the frame 122 of the main section 112 by fasteners, adhesives, welding, and/or can even be formed with the frame 122. Further, some or all of the track 160 can depend below the frame 122 of the main section 112. As such, the auxiliary section 114 can also include different structure (e.g., various support bars) for engagement with the track 160. For example, each end of the auxiliary section 114 can include a generally L-shaped member 181 attached thereto. Further, each L-shaped member 181 can include a projection 183 extending therefrom to form a generally C-shaped geometry for engagement with the track 160. Each L-shaped member 181 can be removably or non-removably attached to the auxiliary section 114, such as by way of fasteners, adhesives, welding, and/or even be formed therewith. Each of the projections 183 can be similarly removably or non-removably attached to the L-shaped members 181. Thus, the support bar(s) can include any or all of the L-shaped 181, projection 183, C-shaped geometry, etc.

As shown, the L-shaped members 181 can be attached to each of the four corners of the auxiliary section 114, though various numbers of L-shaped members 181 can be attached variously to the auxiliary section 114. Thus, if the auxiliary section 114 is removed from the main section 112 (e.g., such as by orienting the auxiliary section 114 at an angle relative to the main section 112), the L-shaped members 181 can act as feet for supporting the auxiliary section 114 upon a supporting surface, such as a countertop or the like. Further, either or both of the L-shaped member 181 and the projection 183 can engage various stop members on the track 160, such as depressions 182, projections, upwardly-extending members 186, etc. for limiting movement of the auxiliary section 114 relative to the main section 112. Either or both of the L-shaped members 181 and the projections can extend in a linear fashion, as shown, or can also have other geometries, such as curved, bent, triangular, square, polygonal, etc.

It is to be appreciated that the auxiliary section 114 can also include various other structure for engagement with the track 160, including but not limited to the structure previously discussed herein (e.g., the ends 76, 78 and structure 80 of the auxiliary rack 14). It is to be appreciated that any end of the auxiliary section 114 can also include various other end geometry or structure for engagement with the track 160 (e.g., telescopic sliders, wheels, rollers, channels, or the like). Further, any of the track 160, L-shaped member 181, and/or projection 183 can include various materials, coatings, lubricants, or the like to facilitate sliding engagement therebetween. Of course, though not shown, the lowered portion 164 of the track 160 can include various depressions or other stop members.

Figure 7:
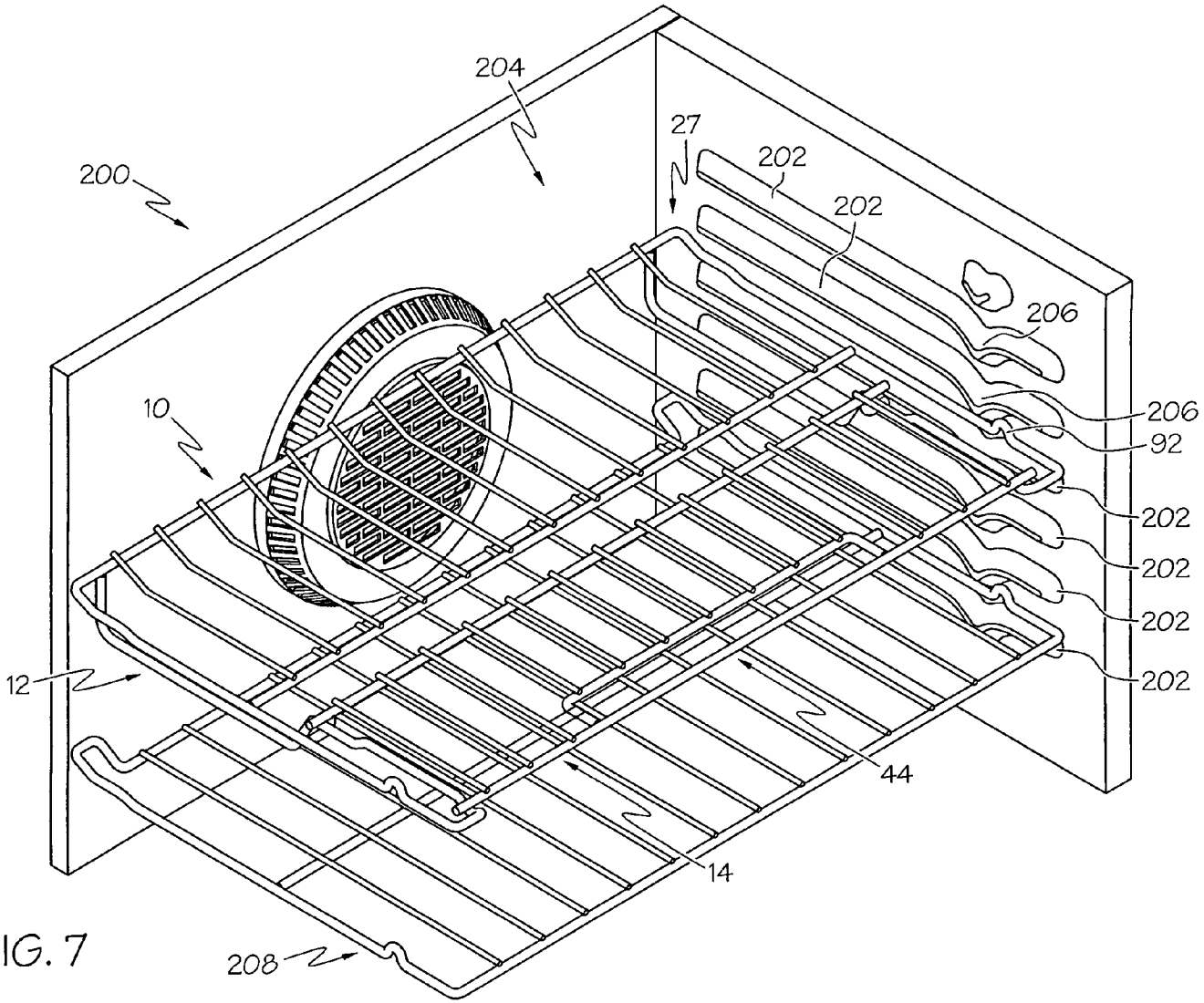
FIG. 7 illustrates the tuck and store rack of FIG. 1 mounted within an oven environment in accordance with another aspect of the present invention.
Figure 8:
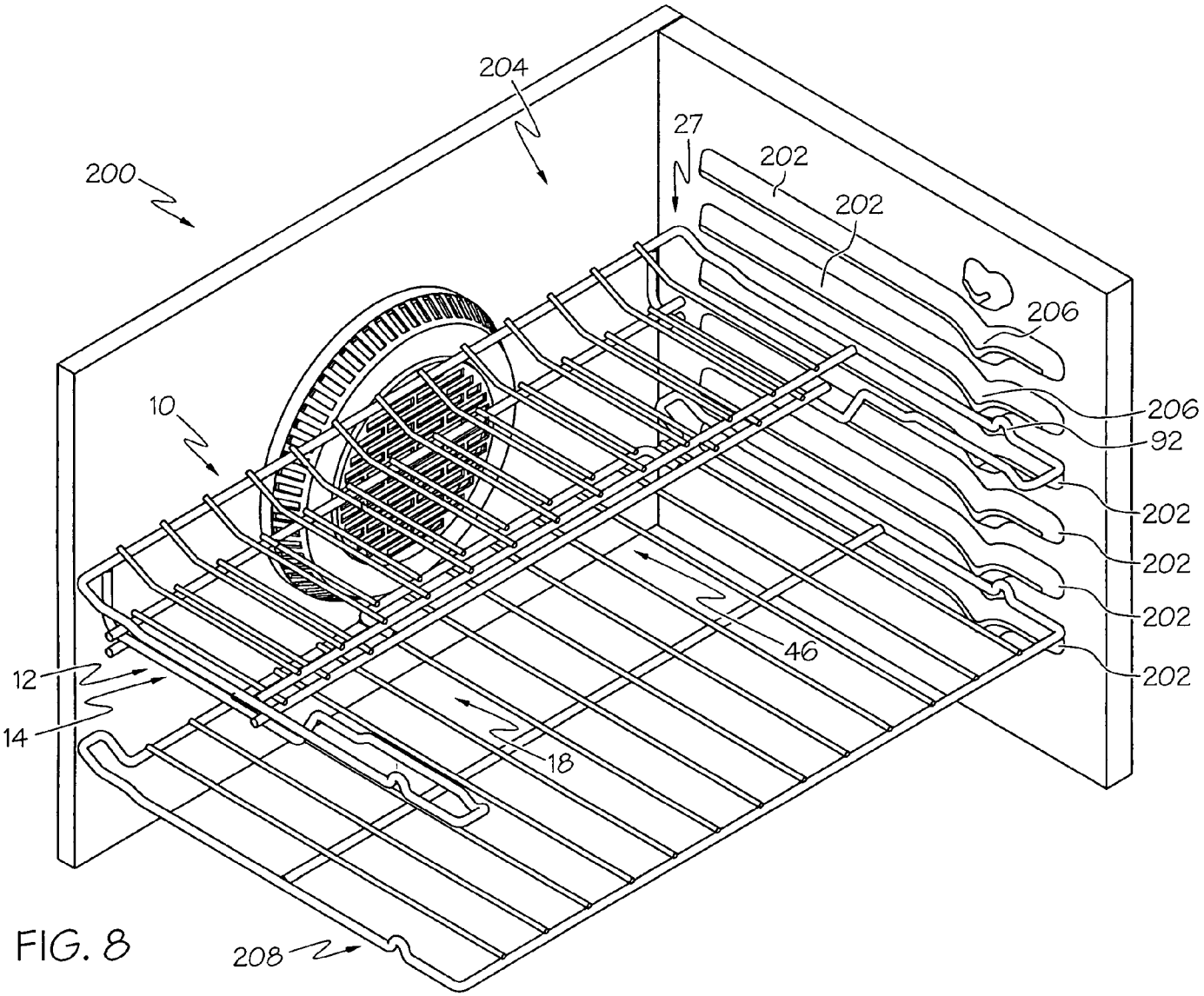
FIG. 8 is similar to FIG. 7, but shows the rack of FIG. 2.

Turning now to the examples shown in FIGS. 7-8, the rack 10 is shown employed within an oven environment 200. Though only the rack 10 is shown, it is to be appreciated that the following description also applies to various other embodiments, such as the rack 110. Thus, as shown, the support frame 22 of the main section 12 can be supported by guide rails 202 within an oven cavity 204. As shown in FIG. 1, the main section 12 can include one or more upward-facing projection(s) 92 integrally formed in the wire frame of each of the sides 28, 30 of the support frame 22 to facilitate alignment of the rack 10 within the oven 200. As shown, the guide rails 202 of the oven 200 can have corresponding downward-facing projections 206. Specifically, the upward-facing projections 92 of the main section 12 can be adapted to contact the downward-facing projections 206 of the top guide rails 202 such that a stop is created to properly align the main section 12 within the standard rack location of the oven 200. In addition or alternatively, the downward-facing projections 206 can also interact with the stops 27 of the main section 12 to inhibit inadvertent removal of the rack 10 from the oven cavity 84.

As shown in FIG. 7, the rack 10 is supported by the guide rails 202 at a relatively upper portion of the oven cavity 204. A second rack 208, illustrated as a traditional oven rack, is also supported by guide rails 202 at a relatively lower portion of the oven cavity 204. The auxiliary section 14 of the rack 10 is shown in the extended position 44 such that it extends over and generally covers the second rack 208. Thus, various items (e.g., food to be cooked, cookware, or the like) can be supported on either or both of the racks 10, 208. However, as can be appreciated, the height of items supported by the second rack 208 will be limited by the distance between the second rack 208 and the auxiliary section 14.

Turning now to the example shown in FIG. 8, the auxiliary section 14 has been moved to the retracted position 46 to create an open area 18 in the rack 10. Thus, with the auxiliary section 14 in the retracted position 46, a "taller" food can be cooked on a lower rack 208 of the oven without the need to remove the entire rack 10 from an upper position in the oven cavity 204, as the taller food can pass through the open area in the rack 10. Accordingly, the primary platform area 16 of the main section 12 can be utilized to support items for cooking such that a full capacity of the oven can be utilized. In addition or alternatively, the auxiliary section 14 can be configured to also support various items when it is in the retracted position 46.

Accordingly, with the rack 10 supported within the oven cavity 204, the primary platform area 16 of the main section 12 and the auxiliary platform area 42 of the auxiliary section 14 can be utilized to support various items for cooking within the oven. The rack 10 can be supported with in the oven cavity 204 in either of the retracted position 44 or the extended position 46. In addition or alternatively, various items can also be supported on other oven racks, such as the second rack 208, simultaneously without the need to add or remove any other racks. It is to be appreciated that the various racks 10, 110 described herein can be utilized with various numbers of various other types of oven racks.

It is to be appreciated that although the example racks 10, 110 have been shown to create an open area 18, 118 located generally towards the front or right-hand side, the racks 10, 110 can also be configured to create open areas 18, 118 at various other locations. For example, the auxiliary section 14 can be configured to move from the rear towards the front to create an open area 18 located towards the rear of the rack 14. Similarly, the auxiliary section 114 can be configured to move from the left towards the right to create an open area 118 located towards the left-hand side of the rack 114. In other examples, the auxiliary section 14, 114 can be configured to move diagonally or in various other manners (e.g., various combinations of movement) to create various other open areas. Further, the rack 10, 110 can include a plurality of auxiliary sections (not shown) for creating a plurality of open areas (not shown).

It is also to be appreciated that the racks of the subject invention can be used in settings other than in an oven. For example, the racks of the subject invention could be used in a refrigerator and/or freezer unit. Further, it is to be appreciated that the racks can be constructed of any suitable material, such as metal, plastic, and the like. Further still, the frame, the bars, and the cross-member(s) need not be constructed from the same materials.

The size of the frame of the rack of the subject invention also depends upon the intended use of the rack. In the example embodiments, the rack is sized to slide into or replace a rack of a conventional oven. Likewise, the bars are spaced to accommodate cookware. The frame can be made larger to fit commercial ovens or sized to fit any apparatus in which the racks are to be used. The bars of the rack can be spaced appropriately within the frame to hold any designated item.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A rack for an appliance including;

a main section including a frame adapted to be supported within a cavity of an appliance, and a primary platform area;

a track coupled to the frame and including a first planar support area and a second planar support area, the second planar support area being disposed below the first planar support area, wherein the frame includes a side bar, and the first planar support area of the track includes a raised portion that is generally horizontally spaced from the side bar of the frame, wherein the second planar support area of the track includes a lowered portion disposed generally below the side bar of the frame, and wherein the track includes a continuous transition slope between the raised portion and the lowered portion; and an auxiliary section continuously supported by the track and having an auxiliary platform area, the auxiliary section adapted to be movable about the track relative to the main section between a retracted position and an extended position, the auxiliary platform area being adapted to support various items when it is in the extended position, wherein the auxiliary section includes a support bar having at least one end configured for sliding engagement with the track, and the at least one end of the support bar includes a generally C-shaped geometry configured for said sliding engagement with the track.

2. The rack of claim 1, wherein the primary platform area is adapted to support various items independent of whether the auxiliary section is in the retracted or extended position.

3. The rack of claim 1, wherein the auxiliary section is adapted to be slidable about the track in a forwards and backwards manner relative to the main section for movement between the retracted and extended positions.

4. The rack of claim 1, wherein the auxiliary section is adapted to be slidable about the track in a side to side transverse manner relative to the main section for movement between the retracted and extended positions.

5. The rack of claim 1, further including a handle portion disposed on the auxiliary section.

6. The rack of claim 1, wherein the track includes at least one stop member adapted to inhibit movement of the auxiliary section.

7. The rack of claim 6, wherein the stop member includes a depression formed in the track.

8. The rack of claim 1, wherein the auxiliary platform area is generally coplanar to the primary platform area when the auxiliary section is in the extended position.

9. The rack of claim 1, wherein the track includes a raised portion that is generally coplanar with the primary platform area.

10. A rack for an appliance including;

a main section including a frame adapted to be supported within a cavity of an appliance, and having a primary platform area with a first plurality of elongated support bars;

a track coupled to the frame and including a first planar support area and a second planar support area, the second planar support area being disposed below the first planar support area; and an auxiliary section continuously supported by the track and having an auxiliary platform area with a second plurality of elongated support bars, the auxiliary section adapted to be movable about the track relative to the main section between a retracted position and an extended position, the auxiliary section being supported by the first planar support area when in the extended position, and by the second planar support area when in the retracted position, wherein the frame includes a side bar, and the first planar support area of the track includes a raised portion that is generally horizontally spaced from the side bar of the frame, wherein the second planar support area of the track includes a lowered portion disposed generally below the side bar of the frame, and wherein the track includes a continuous transition slope between the raised portion and the lowered portion.

11. The rack of claim 10, wherein the primary platform area extends along a first plane and the auxiliary platform area extends along a second plane, the first and second planes being generally coplanar when the auxiliary section is in the extended position.

12. The rack of claim 10, wherein the primary platform area is adapted to support various items independent of whether the auxiliary section is in the retracted or extended position.

13. The rack of claim 10, wherein the auxiliary section is adapted to be slidable about the track in a forwards and backwards manner relative to the main section for movement between the retracted and extended positions.

14. The rack of claim 10, wherein the auxiliary section is adapted to be slidable about the track in a side to side transverse manner relative to the main section for movement between the retracted and extended positions.

15. The rack of claim 10, further including a handle portion disposed on the auxiliary section.

16. The rack of claim 10, wherein the auxiliary section includes a support bar having at least one end configured for sliding engagement with the track.

17. The rack of claim 10, wherein the track includes at least one stop member adapted to inhibit movement of the auxiliary section.

18. The rack of claim 17, wherein the stop member includes a depression formed in the track.

19. A rack for an appliance including;

a main section including a frame adapted to be supported within a cavity of an appliance, and a primary platform area;

a track coupled to the frame and including a first planar support area and a second planar support area, the second planar support area being disposed below the first planar support area, wherein the frame includes a side bar, and the first planar support area of the track includes a raised portion that is generally horizontally spaced from the side bar of the frame, wherein the second planar support area of the track includes a lowered portion disposed generally below the side bar of the frame, and wherein the track includes a continuous transition slope between the raised portion and the lowered portion; and an auxiliary section continuously supported by the track and having an auxiliary platform area, the auxiliary section being movable relative to the main section between a retracted position and an extended position, the rack further including a first stop portion to maintain the auxiliary section in the extended position, and a second stop portion to maintain the auxiliary section in the retracted position.

20. The rack of claim 19, wherein the auxiliary section is adapted to be slidable about the track in a forwards and backwards manner relative to the main section for movement between the retracted and extended positions.

21. The rack of claim 20, wherein at least one of the first and second stops includes a depression formed in the track.

22. The rack of claim 20, wherein the auxiliary section further includes a support bar configured for sliding engagement with the track.

23. The rack of claim 20, wherein the track includes the first stop portion and the second stop portion.

24. The rack of claim 19, wherein the auxiliary section is adapted to be slidable about the track in a side to side transverse manner relative to the main section for movement between the retracted and extended positions.

25. The rack of claim 19, further including a handle portion disposed on the auxiliary section.

26. The rack of claim 19, wherein the primary platform area extends along a first plane and the auxiliary platform area extends along a second plane, the first stop portion being adapted to inhibit movement of the auxiliary section when the second plane is generally coplanar to the first plane.

27. The rack of claim 16, wherein the one end of the support bar includes a generally C-shaped geometry for engagement with the track.

* * * * *